United States Patent [19]

Norman

[11] 4,432,865

[45] Feb. 21, 1984

[54] PROCESS FOR TREATING USED MOTOR OIL AND SYNTHETIC CRUDE OIL

[76] Inventor: George R. Norman, 480-2 Concord Downs Cir., Aurora, Ohio 44202

[21] Appl. No.: 446,791

[22] Filed: Dec. 8, 1982

Related U.S. Application Data

[63] Continuation-in-part of Ser. No. 342,350, Jan. 25, 1982, abandoned.

[51] Int. Cl.[3] ..... C10M 11/00

[52] U.S. Cl. ..... 208/183; 208/180; 208/182; 208/181; 208/252

[58] Field of Search ..... 208/181, 183, 184, 186, 208/252

[56] References Cited

U.S. PATENT DOCUMENTS

| | | | |
|---|---|---|---|
| 3,625,881 | 12/1971 | Chambers | 208/184 |
| 3,819,508 | 6/1974 | Fainman et al. . | |
| 3,835,035 | 9/1974 | Fainman et al. . | |
| 3,919,076 | 11/1975 | Cutler et al. . | |
| 3,930,988 | 1/1976 | Johnson . | |
| 4,021,333 | 5/1977 | Habiby et al. . | |
| 4,028,226 | 6/1977 | Farsberg . | |
| 4,073,719 | 2/1978 | Whisman et al. . | |
| 4,073,720 | 2/1978 | Whisman et al. . | |
| 4,287,049 | 9/1981 | Tabler et al. | 208/181 |
| 4,342,645 | 8/1982 | Fletcher et al. . | |
| 4,366,049 | 12/1982 | Knorre et al. . | |

OTHER PUBLICATIONS

Sullivan, R. F. "Distillate Fuels from Green River Oil Shale", SAE Technical Paper Series 820960.

*Primary Examiner*—Delbert E. Gantz
*Assistant Examiner*—Anthony McFarlan
*Attorney, Agent, or Firm*—Maky, Renner, Otto & Boisselle

[57] ABSTRACT

A process for treating used motor oil or synthetic crude oil comprising: (i) contacting said used motor oil or synthetic crude oil with an effective amount of (A) a polyfunctional mineral acid and/or the anhydride of said acid and (B) a polyhydroxy compound to react undesired contaminants contained in said used motor oil or synthetic crude oil with components (A) and/or (B) to form one or more reaction products; and (ii) separating said reaction products from said used motor oil or synthetic crude oil. A process for reclaiming used motor oil is also disclosed.

45 Claims, 1 Drawing Figure

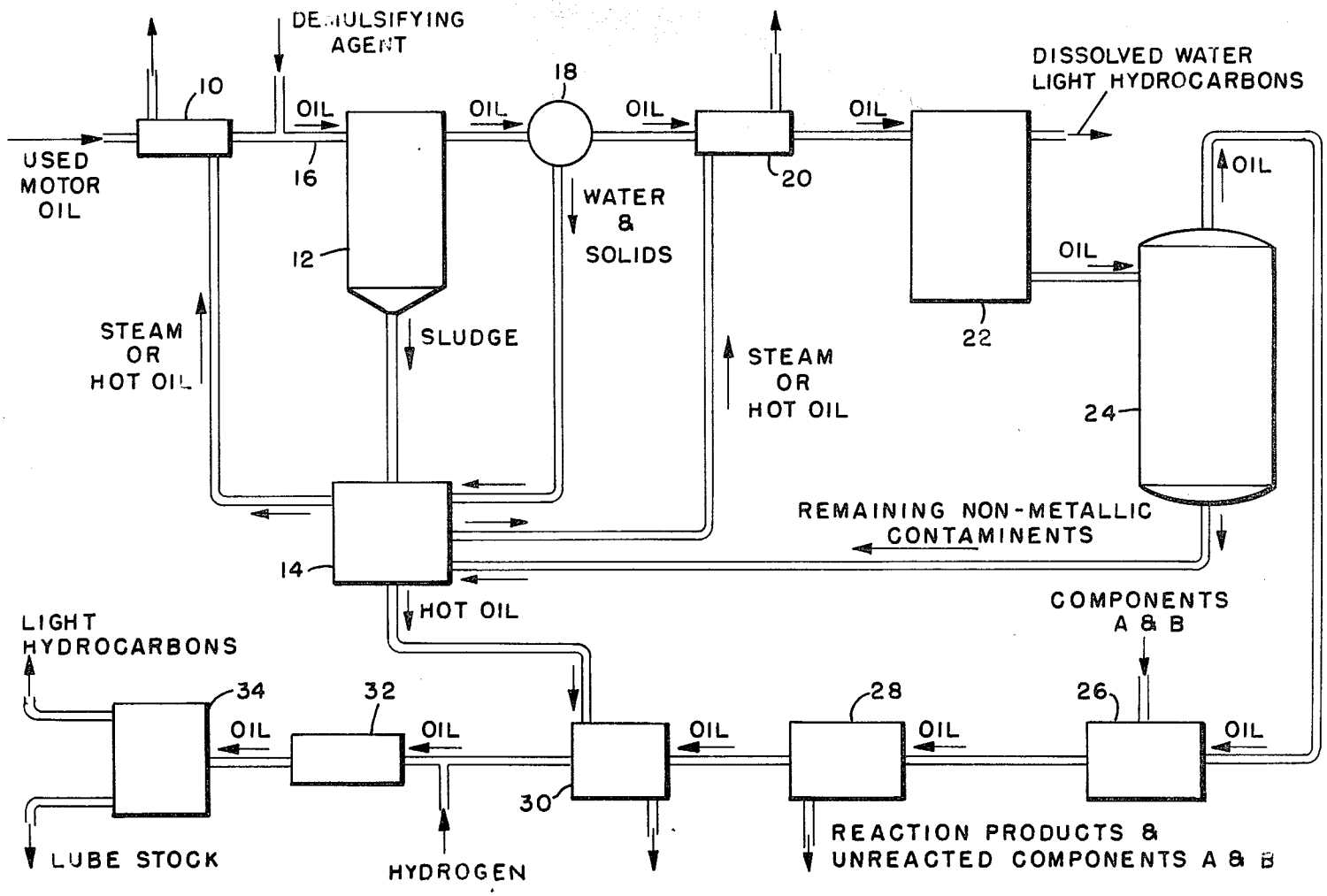
DISSOLVED WATER
LIGHT HYDROCARBONS
OIL
24
22
20
18
16
12
14
10
26
28
30
32
34
COMPONENTS A & B
REMAINING NON-METALLIC CONTAMINENTS
STEAM OR HOT OIL
WATER & SOLIDS
SLUDGE
HOT OIL
DEMULSIFYING AGENT
USED MOTOR OIL
REACTION PRODUCTS & UNREACTED COMPONENTS A & B
HYDROGEN
LIGHT HYDROCARBONS
LUBE STOCK

PROCESS FOR TREATING USED MOTOR OIL AND SYNTHETIC CRUDE OIL

This application is a continuation-in-part of U.S. application Ser. No. 342,350, filed Jan. 25, 1982 now abandoned. The disclosure of this prior application is hereby incorporated by reference into this application in its entirety.

CROSS REFERENCE TO RELATED APPLICATION

Reference is herein made to the copending application of the applicant entitled "Process for Treating Used Industrial Oil", Ser. No. 342,663, filed on Jan. 25, 1982.

TECHNICAL FIELD

This invention relates to the treatment of used motor oil and synthetic crude oil. More specifically, this invention relates to a method for removing contaminants such as undesired nitrogen-containing materials, metallic contaminants, and the like, from used motor oil and synthetic crude oil. In accordance with one aspect of this invention, a process is provided for reducing the metallic content of used motor oils that have been substantially purified of solids, water and light hydrocarbons. In accordance with another aspect of this invention, a process is provided for providing lube stock from used motor oil.

BACKGROUND OF THE INVENTION

The term "used motor oil" is used herein to mean crank case oil from motor vehicles such as, for example, cars, trucks and locomotives, as well as gear oils, automatic transmission fluids and other functional fluids in which the major constituent is an oil of lubricating viscosity. This term does not, however, mean used industrial oils which are blended to specific requirements for use in non-motor vehicle applications in industrial plants or power producing plants.

The term "synthetic crude oil" is used herein to mean any crude oil, regardless of source, other than natural crude petroleum. Synthetic crude oils include oils prepared from naturally occurring bitumen deposits, even though the sources are natural liquids, as well as synthetic hydrocarbon and halosubstituted hydrocarbon oils, alkylene oxide polymers, mono- and dicarboxylic acid esters, synthetic silicon-based oils, etc., all as further discussed below. Synthetic crude oils are useful, for example, in the preparation of lubricants, and normally liquid fuels such as gasoline, kerosene, jet fuel and fuel oil. Processes for the synthesis of synthetic crude oil include liquefication of coal, destructive distillation of kerogen or coal, and extraction or hydrogenation of organic matter in coke liquids, coal tars, tar sands or bitumen deposits, as well as organic synthesis reactions.

Although new reserves of petroleum are from time to time being found, it is generally believed that during the next twenty years new discoveries on a world wide basis will no more than balance the depletion. In the meantime the energy needs for both developing and the developed countries will continue to increase. One approach to this problem has been to encourage better utilization of present supplies, which includes an estimated one billion gallons of used motor oil that is drained, dumped or burned each year in the United States of America. These oils have generally been used as engine crank case lubricants, transmission and gear oils and the like. Used motor oils commonly contain various additives such as detergents, antioxidants, corrosion inhibitors, and extreme pressure additives which are necessary for satisfactory performance, in addition to solid and liquid contaminants, some of which result from oxidation of the oil itself, and generally water and gasoline. Much of this used motor oil could be recovered and reused if it were collected and if it could be effectively reprocessed. Instead, as much as one-third of this used motor oil is indiscriminately dumped, contaminating both land and water. Much of the used motor oil is burned and this too contributes to pollution by releasing metallic oxides from additives in the oil into the atmosphere.

Most existing reclaiming plants for rerefining oil use sulfuric acid to coagulate as an acid sludge the ash and polar components in used oil. This procedure, followed by treatment with alkaline solutions to neutralize the acid, water washing, active clay decolorizing, stripping and filtration yields a lube stock suited to reuse as a low grade motor oil or as a grease base. The poor yield of rerefined oil and environmental problems of disposal of acid sludge and clay make such a reclaiming process a marginal operation at best.

Various alternative approaches have been proposed for reclaiming used motor oil. Propane extraction prior to acid treatment has been reported as reducing the amount of acid and clay required but the yield of recovered oil remains at only about 65% and plant investment costs are much higher. Vacuum distillation has been suggested and work has been done on hydrotreating of distilled oil to lube stock. This latter process leaves a high ash residue and serious problems in fouling of heat exchanger and fractionation equipment has been encountered. Solvent extraction process have been proposed for reclaiming used lubricating oils, but the volume of solvent required has generally been at least equal to the volume of oil being treated and more often at least two to three times the volume of such oil, thus leading to high equipment costs and solvent recovery problems.

A number of processes for reclaiming used oil have been described in the patent literature. For example, U.S. Pat. No. 3,919,076 describes a process for rerefining used automotive lubricating oil that includes the steps of first purifying the oil of debris, dehydrating the oil, then mixing the oil with 1–15 times the volume of such oil of a solvent selected from the group consisting of ethane, propane, butane, pentane, hexane and mixtures thereof, the preferred solvent being propane. The patentee indicates that a special scrubber is used to removed heavy metal particulates from the combustion gases and then the oil-solvent mix is stripped, subjected to vacuum distillation, hydrogenation, another stripping process and filtering. U.S. Pat. No. 3,930,988 describes a process for reclaiming used motor oil by a series of treatments of such oil that includes mixing the oil with ammonium sulfate and/or ammonium bisulfate under conditions that react the sulfate or bisulfate with metal-containing compounds present in the used oil to precipitate contaminants from the oil. The patentee indicates that an optional step of further treating the oil under hydrogenation conditions can be employed to remove additional contaminants and produce a low ash oil product. U.S. Pat. No. 4,021,333 describes a process for rerefining oil by the steps of distilling used oil to remove a forecut having a viscosity substantially less than that of lubricating oil, continuing the distillation to recover a distillate having substantially the viscosity of lubricating oil, extracting impurities from the distillate of the foregoing step with an organic liquid extractant, and removing the organic liquid and impurities dissolved therein from the distillate. U.S. Pat. No. 4,028,226 describes a process for rerefining used oil by the steps of diluting the used oil with a water-soluble polar diluent, removing a major amount of the polar diluent from the solution by addition of water and removal of the resulting aqueous phase, and removing the balance of the polar diluent from the oil. The patentee indicates that useful diluents are the lower alkanols and lower alkanones. U.S. Pat. Nos. 4,073,719 and 4,073,720 describe methods for reclaiming used oil that include the use of a solvent for dissolving the oil and precipitating metal compounds and oxidation products from the oil as sludge. The solvent that is described as being preferred consists of a mixture of isopropyl alcohol, methylethyl ketone and n-butyl alcohol. The solvent-to-used-lubricating-oil ratio is indicated to be in the range of about 8 to about 3 parts solvent to one part oil. U.S. Pat. No. 4,287,049 describes a process for reclaiming used lubricating oil by the steps of contacting the used oil with an aqueous solution of an ammonium salt treating agent in the presence of a polyhydroxy compound at conditions of temperature and pressure sufficient to allow reaction of the treating agent with ash-forming contaminants of the oil thereby producing a precipitate of reacted contaminants, removing a major portion of water and light hydrocarbon components from the reaction mixture, and separating an oil phase from the precipitate by filtration.

A major problem with most reclaiming procedures is the requirement for removing or reducing the level of contaminants, particularly metallic contaminants, to sufficient levels to permit hydrogenation of the reclaimed oil. Most hydrogenation procedures require the use of costly catalyst which can be poisoned by unacceptable levels of such contaminants. Removal or reduction to acceptable levels of such contaminants is essential to the viability of such hydrogenation procedures.

Another approach to this problem has been to encourage the development of alternate fuel and lubricant sources, the most abundant of which are shale oil and coal. The term "shale oil" is a convenient expression used to cover a wide range of fine-grained sedimentary rocks most of which do not contain oil as such, but an organic material believed to be derived mainly from aquatic organisms. The organic constituent of shale oil is called kerogen. Kerogen can be converted to synthetic crude oil by destructive distillation by heating to high temperatures (usually over 900° F.) in a retort. Retorting processes can be divided into three groups: (1) surface retorting, (2) true in situ retorting, and (3) modified in situ retorting. For surface retorting, the shale oil is mined either from the surface by strip mining or underground by room and pillar mining. The rock is then crushed and transported to the retorting vessel. True in situ retorting takes place underground with no mining of the shale. The shale must be fractured by hydraulic pressure, by explosives, or by other means. Modified in situ processes involve some mining to provide a void volume into which the remaining shale can be blasted.

Although most synthetic crude oils derived from shale oil contain less sulfur than Middle Eastern crudes, they contain more nitrogen than typical crudes. For example, synthetic crude oils derived from Green River shale oil usually contains about 1.3–2.2% nitrogen compared to 0.3% for typical petroleum crudes. Nearly all of this nitrogen must be removed prior to conventional refining. A metal contaminant that causes concern in synthetic crude oils derived from shale oil is arsenic. Another metal that can cause problems is iron. Some of the iron may be present as fines; however, up to 70 ppm iron can pass through a 0.45-micron filter and may be bonded in organic compounds. Additionally, nickel, and shale rock particles (known as "fines" or "ash") are potential sources of processing problems. These impurities must be removed prior to transporting synthetic crude oil in common carrier pipelines and prior to refining.

The liquefication of coal for producing synthetic crude oil is of particular significance due to the abundant deposits of coal that are available, particularly in the United States. The major differences between coal and petroleum are the ratio of hydrogen to carbon and the ash content. Coal has an atomic hydrogen to carbon ratio of about 0.8, while the ratio for oil is of the order of about 1.8. Coal has an ash content that can be as high as about 15%, whereas oil seldom has over a few tenths of a percent. The problem, then, in coal liquefication is to increase the hydrogen content of the material and to eliminate the ash. Coal liquefication processes can be grouped into three general categories; pyrolysis, extraction-hydrogenation, and indirect liquefication. In pyrolysis, coal is heated to a temperature at which it begins to decompose and gives off liquids and gases, leaving behind a carbonaceous solid called char. The liquids in gases are higher in hydrogen content than the original coal, while the char is lower in hydrogen. In the extraction-hydrogenation process, hydrogen is added to the coal by a number of different methods, and smaller amounts are rejected. In indirect liquefication, large amounts of hydrogen are added and large amounts of carbon in the form of carbon dioxide are removed. With each type of liquefication, the removal of contaminants, particulaly metallic contaminants, from the resulting synthetic crude oil is essential prior to refining it.

It would be advantageous to provide a process for treating used motor oil and synthetic crude oil to remove undesired contaminants, particularly undesired nitrogen-containing materials and metallic contaminants, sufficiently to permit further processing of such used motor oil (e.g., hydrogenation) and synthetic crude oil (e.g., conventional refining).

SUMMARY OF THE INVENTION

The present invention relates to a process for treating used motor oil and synthetic crude oil to remove undesired contaminants, particulary undesired nitrogen-containing materials and metallic contaminants, from such used motor oil or synthetic crude oil to permit further processing of the used motor oil (e.g., hydrogenation) and the synthetic crude oil (e.g., conventional refining).

Broadly stated, the present invention contemplates the provision of a process for treating used motor oil or synthetic crude oil comprising:

(i) contacting said used motor oil or synthetic crude oil with an effective amount of (A) a polyfunctional mineral acid and/or the anhydride of said acid and (B) a polyhydroxy compound to react undesired contaminants contained in said used motor oil or synthetic crude oil with components (A) and/or (B) to form one or more reaction products; and (ii) separating said reaction products from said used motor oil or synthetic crude oil.

In a preferred embodiment component (B) is in excess of component (A) during step (i).

In accordance with one aspect of the present invention a process is provided for reducing the metallic content of used motor oil comprising the steps of: (i) contacting said use motor oil with an effective amount of (A) a polyfunctional mineral acid and/or the anhydride of said acid and (B) a polyhydroxy compound until substantially all of said metallic contaminants have reacted with components (A) and/or (B) to form one or more reaction products; and (ii) separating said reaction products and any unreacted components (A) and/or (B) from said used motor oil. Preferably component (B) is in excess of component (A). This process is particularly suitable for enhancing the purification of used motor oil sufficiently to permit subsequent hydrotreatment using costly hydrogenation catalysts in a manner to avoid poisoning such catalysts.

In accordance with another aspect of the present invention a process for reclaiming used motor oil is provided comprising the steps of: (i) separating bulk water and solid contaminants from said oil; (ii) separating fine particulates and remaining suspended water from said oil; (iii) vacuum drying said oil at a temperature in the range of about 250° F. to about 400° F. and a pressure in the range of about 2 to about 50 torr to remove dissolved water and light hydrocarbons from said oil; (iv) vacuum distilling said oil at a temperature in the range of about 40° F. to about 350° F. and a pressure in the range of about 0.001 to about 0.1 torr to separate substantially all remaining non-metallic contaminants from said oil; (v) contacting said oil with an effective amount of (A) a polyfunctional mineral acid and/or the anhydride of said acid and (B) a polyhydroxy compound until substantially all metallic contaminants in said oil have reacted with components (A) and/or (B) to form one or more reaction products; (vi) separating the reaction products formed in step (v) and any unreacted components (A) and/or (B) from said oil; (vii) hydrotreating said oil in the presence of hydrogen and a hydrogenation catalyst at a temperature in the range of about 500° F. to about 800° F. to remove residual polar materials and unsaturated compounds; and (viii) stripping said oil to remove light hydrocarbons with boiling points below about 600° F. The expression "substantially all metallic contaminants" is used herein to refer to the requirement that metallic contaminants must be sufficiently removed from the oil prior to hydrogenation to avoid poisoning the hydrogenation catalysts.

BRIEF DESCRIPTION OF THE DRAWING

The attached drawing is a schematic flow diagram illustrating a preferred embodiment of the process of the present invention for reclaiming used motor oil.

DESCRIPTION OF THE PREFERRED EMBODIMENT

Further features and advantages of the present invention will become apparent to those skilled in the art from the description of the preferred embodiment herein set forth.

The used motor oil that can be treated in accordance with the process of the present invention includes used crank case oil from motor vehicles such as, for example, cars, trucks and locomotives, as well as automatic transmission fluids and other functional fluids (other than industrial oils which are blended to specific requirements for use in non-motor vehicle applications in industrial plants or power producing plants) in which the major constituent is an oil of lubricating viscosity. Included within this group are used motor oils having mineral lubricating oils such as liquid petroleum oils and solvent-treated or acid-treated mineral lubricating oils of the paraffinic, naphthenic or mixed paraffinic-naphthenic types as the base oil. Oils of lubricating viscosity derived from coal or shale oil can also be included as the base oil of such used motor oils. This group also includes used motor oils having as the base oil synthetic lubricating oils including hydrocarbon oils and halosubstituted hydrocarbon oils such as polymerized and interpolymerized olefins (e.g., polybutylenes, polypropylenes, propyleneisobutylene copolymers, chlorinated polybutylenes, etc.); poly(1-hexenes), poly(1-octenes), poly(1-decenes), etc. and mixtures thereof; alkylbenzenes (e.g., dodecylbenzenes, tetradecylbenzenes, dinonylbenzenes, di(2-ethylhexyl)benzenes, etc.); polyphenyls (e.g., biphenyls, terphenyls, alkylated polyphenyls, etc.); alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc. constitute another class of known synthetic lubricating oils that can be the base oil of the used motor oils treated in accordance with the present invention. These are exemplified by the oils prepared through polymerization of ethylene oxide or propylene oxide, the alkyl and aryl ethers of these polyoxyalkylene polymers (e.g., methylpolyisopropylene glycol ether having an average molecular weight of 1000, diphenyl ether of polyethylene glycol having a molecular weight of 500–1000, diethyl ether of polypropylene glycol having a molecular weight of 1000–1500, etc.) or mono- and polycarboxylic esters thereof, for example, the acetic acid esters, mixed $C_3$–$C_8$ fatty acid esters, or the $C_{13}$ Oxo acid diester of tetraethylene glycol.

Another suitable class of synthetic lubricating oils that can be the base oil of the used motor oils treated in accordance with the present invention comprises the esters of dicarboxylic acids (e.g., phthalic acid, succinic acid, alkyl succinic acids and alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid, and the like.

Esters useful as synthetic oils that the used motor oil to be treated can be derived from also include those made from $C_5$ to $C_{12}$ monocarboxylic acids and polyols and polyol ethers such as neopentyl glycol, trimethylolpropane, pentaerythritol, dipentaerythritol, tripentaerythritol, etc.

Silicon-based oils such as the polyalkyl-, polyaryl-, polyalkoxy-, or polyaryloxy-siloxane oils and silicate oils comprise another class of synthetic oils that can be the base oil of the used motor oils that can be treated (e.g., tetraethyl silicate, tetraisopropyl silicate tetra-(2-ethylhexyl) silicate, tetra-(4-methyl-2-ethylhexyl) silicate, tetra-(p-tert-butylphenyl) silicate, hexa-(4-methyl-2-pentoxy)-disiloxane, poly(methyl)siloxanes, poly(methylphenyl)siloxanes, etc.). Other synthetic oils include liquid esters of phosphorus-containing acids (e.g., tricresyl phosphate, trioctyl phosphate, diethyl ester of decylphosphonic acid, etc.), polymeric tetrahydrofurans and the like.

The term "of lubricating viscosity" when used herein does not limit the utility of the oil to lubricating, but is merely a description of a property thereof.

The foregoing used motor oils usually contain one or more of various additives such as, for example, oxidation inhibitors (i.e., barium, calcium and zinc alkyl thiophosphates, di-t-butyl-p-cresol, etc.), anti-wear agents (i.e., organic lead compounds such as lead diorganophosphorodithioates, zinc dialkyldithiophosphates, etc.), dispersants, (i.e., calcium and barium sulfonates and phenoxides, etc.), rust inhibitors (i.e., calcium and sodium sulfonates, etc.), viscosity index improvers, (i.e., polyisobutylenes, poly-alkylstyrene, etc.), detergents (i.e., calcium and barium salts of alkyl and benzene sulfonic acids and ashless type detergents such as alkyl-substituted succinimides, etc.). Additionally, the used motor oils treated in accordance with the present invention usually contain various con-taminants resulting from incomplete fuel combustion as well as water and gasoline. The process of the present invention is particularly suitable for removing or reducing to acceptable levels (e.g., to permit subsequent hydrogenation without poisoning the hydrogenation catalyst) the above indicated nitrogen-containing materials and metal-containing materials.

The synthetic crude oils that can be treated in accordance with the process of the present invention include any crude oil, regardless of source, other than natural crude petroleum. These oils include oils prepared from naturally occurring bitumen deposits, even though the sources are natural liquids. These oils also include synthetic crude oils from which the synthetic base oils of the above-indicated use motor oils are derived (e.g., synthetic hydrocarbon and halosubstituted hydrocarbon oils, alkylene oxide polymers, mono- and dicarboxylic acid esters, synthetic silicon-based oils, etc.). The most abundant sources for these synthetic crude oils are shale oil and coal. Processes for the synthesis of such synthetic crude oils include liquefication of coal, destructive distillation of kerogen or coal, extraction or hydrogenation of organic matter in coke liquids, coal tars, tar sands or bitumen deposits, as well as conventional organic synthesis processes, all of which are well known to those skilled in the art and, accordingly, need not be further described herein.

Representative examples of the polyfunctional mineral acids that can be used in accordance with the present invention as component (A) include: arsenic acid, arsenious acid, boric acid, metaboric acid, chromic acid, dichromic acid, orthoperiodic acid, manganic acid, nitroxylic acid, hyponitrous acid, phosphoric acid, metaphosphoric acid, peroxomonophosphoric acid, diphosphoric acid, selenic acid, selenious acid, orthosilicic acid, metasilicic acid, technetic acid, peroxodiphosphoric acid, hypophosphoric acid, phosphonic acid, diphosphonic acid, rhenic acid, sulfuric acid, disulfuric acid, peroxomonosulfuric acid, thiosulfuric acid, dithionic acid, sulfurous acid, disulfurous acid, thiosulfurous acid, dithionous acid, sulfoxylic acid, polythionic acid and orthotelluric acid. The preferred acids are phosphoric acid and sulfuric acid. Alternatively, component (A) can be the anhydride of any of the foregoing acids. The preferred anhydrides are diphosphorouspentoxide, diphosphorouspentsulfide and sulfur trioxide.

Component (B) can be selected from a wide variety of organic polyhydroxy compounds which includes aliphatic, cycloaliphatic and aromatic polyhydroxy compounds and such compounds may be monomeric or polymeric. The polyhydroxy compounds may contain other functionality including ether groups, ester groups, etc. Representative examples of the monomeric polyols or polyhydroxy compounds including aliphatic, cycloaliphatic and aromatic compounds for use in accordance with the present invention include: ethylene glycol, propylene glycol, trimethylene glycol, 1,2-butylene glycol, 1,3-butane diol, 1,4-butane diol, 1,5-pentane diol, 1,2-hexylene glycol, 1,10-decane diol, 1,2-cyclohexane diol, 2-butene-1,4-diol, 3-cyclohexene-1,1-dimethanol, 4-methyl-3-cyclohexene,1,1-dimethanol, 3-methylene-1,5-pentanediol, 3,2-hydroxyethyl cyclohexanol, 2,2,4-trimethyl-1,3-pentanediol, 2,5-dimethyl-2,5-hexane diol, and the like; alkylene oxide modified diols such as diethylene glycol, (2-hydroxyethoxy)-1-propanol, 4-(2-hydroxyethoxy)-1-butanol, 5-(2-hydroxyethoxy)-1-pentanol, 3-(2-hydroxypropoxy)-1-propanol, 4-(2-hydroxypropoxy)-1-butanol, 5-(2-hydroxypropoxy)-1-pentanol, 1-(2-hydroxyethoxy)-2-butanol, 1-(2-hydroxyethoxy)-2-pentanol, 1-(2-hydroxymethoxy)-2-hexanol, 1-(2-hydroxyethoxy)-2-octanol, and the like. Representative examples of ethylenically unsaturated low molecular weight polyols include 3-allyloxy-1,5-pentandiol, 3-allyloxy-1,2-propanediol, 2-allyloxymethyl-2-methyl-1,3-propanediol, 2-methyl-2-[(4-pentenyloxy)methyl]-1,3-propanediol, and 3-(o-propenylphenoxy)-1,2-propanediol. Representative examples of low molecular weight polyols having at least 3 hydroxyl groups include glycerol, 1,2,6-hexanetriol, 1,1,1-trimethylolpropane, 1,1,1-trimethylolethane, pentaerythritol, 3-(2-hydroxyethoxy)-1,2-propanediol, 3-(2-hydroxypropoxy)-1,2-propanediol, 6-(2-hydroxypropoxy)-1,2-hexanediol, 2,(2-hydroxyethoxy)-1,2-hexanediol, 6-(2-(hydroxypropoxy)-1,2-hexanediol, 2,4-dimethyl-2-(2-hydroxyethoxy)methylpentanediol-1,5:mannitol, glacitol, talitol, iditol, allitol, altritol, guilitol, arabitol, ribitol, xylitol, erythritol, threitol, 1,2,5,6-tetrahydroxyhexane, meso-inisitol, sucrose, glucose, galactose, mannose, fructose, xylose, arabinose, dihydroxyacetone, glucose-alphamethylglucoside, 1,1,1-tris[(2-hydroxyethoxy)-methyl] ethane, and 1,1,1-tris[(2-hydroxypropoxy)-methyl] propane. Exemplary diphenylol compounds include 2,2-bis(p-hydroxyphenyl) propane, bis(p-hydroxyphenylmethane and the various diphenols and diphenylol methanes disclosed in U.S. Pat. Nos. 2,506,486 and 2,744,882, respectively. Each of these patents being incorporated herein by reference. Exemplary triphenylol compounds which can be employed include the alpha, alpha, omega, tris(hydroxypenyl)alkanes such as 1,1,3-tris(hydroxyphenyl)ethane, 1,1,3-tris(hydroxyphenyl)propane, 1,1,3-tris(hydroxy-3-methylphenyl)propane, 1,1,3-tris(dihydroxy-3-methylphenyl)propane, 1,1,3-tris(hydroxy-2,4-dimethylphenyl)propane, 1,1,3-tris(hydroxy-2,5-dimethylphenyl)propane, 1,1,3-tris(hydroxy-2,6-dimethylphenyl)propane, 1,1,4-tris(hydroxyphenyl)butane, 1,1,4-tris(hydroxyphenyl)-2-ethylbutane, 1,1,4-tris(dihydroxyphenyl)butane, 1,1,5-tris(hydroxyphenyl)-3-methylpentane, 1,1,8-tris(hydroxyphenyl)-octane, and 1,1,10-tris(hydroxyphenyl)decane. Tetraphenylol compounds which can be used in this invention include the alpha, alpha, omega, omega, tetrakis(hydroxyphenyl)alanes such as 1,1,2,2-tetrakis(hydroxy-phenyl)ethane, 1,1,3,3-tetrakis(hydroxy-3-methylphenyl)propane, 1,1,3,3-tetrakis(dihydroxy-3-methylphenyl)propane, 1,1,4,4-tetrakis(hydroxyphenyl)butane, 1,1,4,4-tetrakis(hydroxyphenyl)-2-ethylbutane, 1,1,5,5-tetrakis(hydroxyphenyl)pentane, 1,1,5,5-tetrakis(hydroxyphenyl)-3-methylpentane, 1,1,5,5-tetrakis(dihydroxyphenyl)pentane, 1,1,8,8-tetrakis(hydroxy-3-butylphenyl)octane, 1,1,8,8-tetrakis(dihydroxy-3-butylphenyl)octane, 1,1,8,8-tetrakis(hydroxy-2,5-dimethylphenyl)octane, 1,1,10,10-tetrakis(hydroxyphenyl)decane, and the corresponding compounds which contain substituent groups in the hydrocarbon chain such as 1,1,6,6-tetrakis(hydroxyphenyl)-2-hydroxyhexane, 1,1,6,6-tetrakis(hydroxyphenyl)-2-hydroxy-5-methyl-hexane, and 1,1,7,7-tetrakis(hydroxyphenyl)-3-hydroxyheptane.

By polymeric polyhydroxy compound is meant a linear long-chain polymer having terminal hydroxyl groups including branched, polyfunctional polymeric hydroxy compounds as set forth below. Among the suitable polymeric polyhydroxy compounds, there are included polyether polyols such as polyalkyleneether glycols and polyalkylene-aryleneether-thioether glycols, polyalkyleneether triols. Mixtures of these polyols may be used when desired.

The polyalkyleneether glycols may be represented by the formula $HO(RO)_nH$, wherein R is an alkylene radical which need not necessarily be the same in each instance and n is an integer. Representative glycols include polyethyleneether glycol, polypropyleneether glycol, polytrimethyleneether glycol, polytetramethylene ether glycol, polypentamethyleneether glycol, polydecamethyleneether glycol, polytetramethylene formal glycol and poly-1,2-dimethylethyleneether glycol. Mixtures of two or more polyalkyleneether glycols may be employed if desired.

The organic polyhydroxy compounds may be polyoxyalkylene compounds such as obtained by condensation of an excess of one or more alkylene oxides with an aliphatic or aromatic polyol. Such polyoxyethylene compounds are available commercially under the general trade designations "Surfynol" by Air Products and Chemicals, Inc. of Wayne, Pa., and under the designation "Pluronic" or "Tetronic" by BASF Wyandotte Corp. of Wyandotte, Mich. Examples of specific polyoxyethylene condensation products useful in the invention include "Surfynol 465" which is a product obtained by reacting about 10 moles of ethylene oxide with 1 mole of tetramethyldecynediol. "Surfynol 485" is the product obtained by reacting 30 moles of ethylene oxide with tetramethyldecynediol. "Pluronic L 35" is a product obtained by reacting 22 moles of ethylene oxide with polypropylene glycol obtained by the condensation of 16 moles of propylene glycol.

Carbowax-type compositions which are polyethylene glycols having different molecular weights can also be used. For example Carbowax No. 1000 has a molecular weight range of from about 950 to 1,050 and contains from 20 to 24 ethoxy units per molecule. Carbowax No. 4000 has a molecular weight range of from about 3000 to 3700 and contains from 68 to 85 ethoxy units per molecule. Other known nonionic glycol derivatives such as polyalkylene glycol ethers and methoxy polyethylene glycols which are available commercially can be utilized.

Representative polyalkyleneether triols are made by reacting one or more alkylene oxides with one or more low molecular weight aliphatic triols. Examples include: ethylene oxide; propylene oxide; butylene oxide, 1,2-epoxybutane; 1,2-epoxyhexane; 1,2-epoxyoctane; 1,2-epoxyhexadecane; 2,3-epoxybutane; 3,4-epoxyhexane; 1,2-epoxy-5-hexene; and 1,2-epoxy-3-butane, and the like. In addition to mixtures of these oxides, minor proportions of alkylene oxides having cyclic substituents may be present, such as styrene oxide, cyclohexene oxide, 1,2-epoxy-2-cyclohexylpropane, and a methyl styrene oxide. Examples of aliphatic triols include glycerol, 1,2,6-hexanetriol; 1,1,1-trimethylolpropane; 1,1,1-trimethylolethane; 2,4-di-methylol-2-methylol-pentanediol-1,5 and the trimethylether of sorbitol.

Representative examples of the polyalkyleneether triols include: polypropyleneether triol (M.W. 700) made by reacting 608 parts of 1,2-propyleneoxide with 92 parts of glycerine; polypropyleneether triol (M.W. 1535) made by reacting 1401 parts of 1,2-propyleneoxide with 134 parts of trimethylolpropane; polypropyleneether triol (M.W. 2500) made by reacting 2366 parts of 1,2-propyleneoxide with 134 parts of 1,2,6-hexanetriol; and polypropyleneether triol (M.W. 6000) made by reacting 5866 parts of 1,2-propyleneoxide with 134 parts of 1,2,6-hexanetriol. Additional suitable polytriols include polyoxypropylene triols, polyoxybutylene triols, Union Carbide's Niax triols LG56, LG42, LG112 and the like; Jefferson Chemicals's Triol G-4000 and the like; Actol 32-160 from National Aniline and the like.

The polyalkylene-aryleneether glycols are similar to the polyalkyleneether glycols except that some arylene radicals are present. Representative arylene radicals include phenylene, naphthalene and anthracene radicals which may be substituted with various substituents, such as alkyl groups. In general, in these glycols there should be at least one alkyleneether radical having a molecular weight of about 5000 for each arylene radical which is present.

The polyalkyleneether-thioether glycols and the polyalkylene-aryleneether glycols are similar to the above-described polyether glycols, except that some of the etheroxygen atoms are replaced by sulfur atoms. These glycols can be prepared conveniently by condensing together various glycols such as thiodiglycol, in the presence of a catalyst such as p-toluenesulfonic acid.

Preferably, component (B) consists of cellulose fibers, polyvinyl alcohol, phenol formaldehyde resin, glycerol or ethylene glycol. Cellulose fibers are particularly preferred due to availability and cost.

The process of the present invention is particularly suitable for removing undesirable levels of nitrogen-containing materials and metallic contaminants from used motor oil and synthetic crude oil. Preferably all, or substantially all, of such nitrogen-containing materials and/or metallic contaminants are removed from the used motor oil prior to hydrogenating it and from the synthetic crude prior to transporting the crude through common carrier pipelines and/or refining it. The expression "substantially all" is used herein to refer to the requirement that the nitrogen-containing materials and metallic contaminants be removed sufficiently to permit hydrogenation of the used motor oil without poisoning the hydrogenation catalyst and transport of the synthetic crude through common carrier pipelines and/or refining, the specific level or degree of removal being dependent on the specific requirements for such hydrogenation process, transport or refining process.

The process of the present invention is preferably carried out in a stirred vessel. The vessel can be entirely conventional in design and construction. The size, design and construction of such vessel is dependent upon the volume of used motor oil or synthetic crude oil to be processed. An effective amount of component (A) and an effective amount of component (B) are mixed with the oil to be processed in the vessel until all or substantially all of the undesired nitrogen-containing materials and/or metallic contaminants have reacted with components (A) and/or (B). Preferably, components (A) and (B) are each provided at a level of about 0.1 to about 5% by weight, based on the weight of the oil in the vessel. Preferably, component (B) is provided in excess of component (A) to facilitate separation of unreacted components (A) and/or (B). The ratio of component (B) to component (A) preferably ranges from a slight excess to about 5:1, more preferably from a slight excess to about 2:1. The temperature of the oil being processed is preferably maintained in the range of about 40° F. to about 350° F., more preferably about 150° F. to about 250° F. When component (B) is a fibrous material (e.g., cellulose fibers) the reaction products of the undesired nitrogen-containing materials and/or metal contaminants and components (A) and/or (B) and any unreacted components (A) and/or (B) can be separated from the oil with a rotary vacuum filter, for example, the design and construction of such filter being entirely conventional and dependent upon the volume of oil being processed and the specific nature of the fibrous material. In instances wherein component (B) is a liquid, separation can be effected with a high speed centrifuge or by adsorption and/or absorption with clay or cellulose fibers. When component (B) is a fibrous material the reaction products of the metal contaminants with components (A) and/or (B) and any unreacted components (A) and/or (B), can be incinerated to provide a heat source. The level or degree of removal of such undesired nitrogen-containing materials and/or metallic contaminants is dependent upon the requirements for subsequent processing or treatment of the used motor oil or synthetic crude oil (e.g., hydrotreatment in the case of used motor oil, and transport in common carrier pipelines and/or conventional refining in the case of synthetic crude oil).

The reaction mechanism between the undesired nitrogen-containing materials and/or metallic contaminants and components (A) and/or (B) is not known. In some instances it appears that the reaction is between the nitrogen-containing materials and/or metallic contaminants and component (A), while in other instances it appears that the reaction is with component (B), while still in other instances it appears that the reaction is between the nitrogen-containing materials and/or metallic contaminants and both components (A) and (B). Whether the reaction is with either component (A) or (B) or both, the presence of both components (A) and (B) is essential.

Referring to the drawing, used motor oil is initially heated in preheater 10 and then advanced to insulated settling tank 12. The oil is heated to a temperature that is high enough to reduce the viscosity of the oil sufficiently to enhance separation of bulk water and solid contaminants from the oil, but low enough to prevent the vaporization of undesirable quantities of relatively volatile materials, such as gasoline. A preferred temperature for the operation of preheater 10 and settling tank 12 is in the range of about 100° F. to about 180° F. The required residence time for the oil in settling tank 12 is dependent upon the level of bulk water and solid contaminants that are to be removed from the oil, but is preferably in the range of about 12 to about 24 hours. Preheater 10 is preferably a steam heated shell and tube heat exchanger, although it can also be heated with hot oil. Preferably, such steam or hot oil is heated in incinerator 14, as discussed below. The design and construction of preheater 10 and settling tank 12 is entirely conventional and dependent upon the volume of oil to be processed.

Advantageously, a demulsifying agent is admixed with the oil to enhance the separation of bulk water and solid contaminants from the oil during the settling step in tank 12. The demulsifying agent is preferably admixed with the oil in feed line 16 to take advantage of turbulence in the line to provide for enhanced mixing of the demulsifying agent with the oil. An example of a commercially available demulsifying agent that is useful with the process of the present invention is Betz 380, a product of Betz Laboratories, Inc. The demulsifying agent is preferably admixed with the oil at a level in the range of about 100 to about 5000 parts demulsifying agent per one million parts of oil, i.e., about 100 to about 5000 pm, preferably about 1000 ppm. The utilization of such a demulsifying agent is preferred but not critical.

The sludge from settling tank 12 is advanced to incinerator 14 wherein it is incinerated. The heat generated during the incineration of such sludge as well as other contaminants removed from the oil downstream of the settling tank 12, as discussed below, is preferably used as a heat source for preheater 10 as well as heat exchangers 20 and 30, as discussed below. The medium for transferring heat from incinerator 14 to preheater 10 as well as heat exchangers 20 and 30 is preferably steam or hot oil. The design and construction of incinerator 14 is entirely conventional, and dependent upon the volume of oil to be processed and appropriate environmental considerations.

The oil with bulk water and solid contaminants removed is advanced from settling tank 12 to high speed centrifuge 18. High speed centrifuge 18 is employed for removing fine particulates and any remaining suspended water from the oil. The centrifuge is preferably designed to provide for the separation of the oil and water from the particulates followed by subsequent separation of the oil and water. An example of a commercially available high speed centrifuge that can be used in accordance with the present invention is a De Lavall high speed centrifuge which is designed for operation at a rate of about 12,000 or 13,000 RPM. The design and construction of the centrifuge, however, should be understood as being entirely conventional and dependent upon the volume of oil to be processed and the anticipated separation requirements for the centrifuge. Other high speed centrifuges in addition to the foregoing De Lavall centrifuge can be used.

The water and particulate fines removed from the oil in centrifuge 18 are advanced to incinerator 14. The oil is advanced from centrifuge 18 to heat exchanger 20. The temperature of the oil is raised to about 250° to about 400° F., preferably about 350° F. to about 400° F.

in heat exchanger 20. The oil is then advanced to vacuum drier 22. Heat exchanger 20 can be heated with steam when the temperature of the oil need not be above about 350° F. However if higher temperatures are required, hot oil is preferably used as the heat transfer medium.

Vacuum drier 22 is preferably operated at a temperature in the range of about 250° F. to about 400° F., preferably about 350° F. to about 400° F., and at a pressure in the range of about 2 to about 50 torr, preferably about 10 to about 25 torr. The residence time of the oil in the vacuum drier is provided so as to be sufficient to remove dissolved water, light hydrocarbons, i.e., hydrocarbons boiling below about 600° F., and noncondensables, such as air, from the oil. Vacuum drier 22 is preferably a falling film evaporator of conventional design. The design and construction of the drier 22 is dependent upon the volume of oil to be processed and the anticipated separation requirements for the drier. The dried and degased oil is advanced from vacuum drier 22 to still 24.

Still 24 is preferably a high vacuum, short path, thin film still that is operated at a pressure in the range of about 0.001 to about 0.1 torr, preferably about 0.001 to about 0.05 torr, and a temperature in the range of about 40° F. to about 350° F., preferably about 100° F. to about 350° F. The design and construction of still 24 is entirely conventional and dependent upon the volume of oil to be processed. Still 24 is operated under such conditions so as to remove, with the exception of a portion of the metallic contaminants, all or substantially all remaining contaminants in the oil. Metallic contaminants are removed from the oil in still 24, but generally not in sufficient quantities to avoid damaging or poisoning the hydrogenation catalysts discussed below. At the indicated operating temperatures, coking of the still is generally insignificant. Temperatures above about 350° F. are, however, to be avoided to avoid excessive coking. The bottoms from still 24 are advanced to incinerator 14. The distilled oil from still 24 is advanced to reactor 26.

Reactor 26 is provided for the purpose of removing or reducing to acceptable levels the undesired nitrogen-containing materials and metallic contaminants remaining in the oil prior to subjecting the oil to hydrogenation, as discussed below. In reactor 26 the oil is mixed with (A) from about 0.1 to about 5% by weight, preferably about 0.5% by weight, based on the weight of the oil in reactor 26 of a polyfunctional mineral acid and/or the anhydride of such acid and (B) from about 0.1 to about 5% by weight, preferably about 1% by weight based on the weight of the oil in reactor 26 of a polyhydroxy compound. The reaction between the undesired nitrogen-containing materials and/or metallic contaminants in the oil and component (A) and/or component (B) is continued in reactor 26 until all or substantially all of the undesired nitrogen-containing materials and/or metallic contaminants in the oil have reacted with either or both components (A) and (B). It is preferable that component (B) is provided in excess of component (A). The ratio of component (B) to component (A) preferably ranges from a slight excess to about 5:1, more preferably from a slight excess to about 2:1. The temperature of the oil in reactor 26 is generally in the range of about 40° F. to about 350° F., preferably about 150° F. to about 250° F. Reactor 26 is preferably an agitated vessel that is entirely conventional in design and construction, the exact size, design and construction being dependent upon the volume of oil to be processed.

The oil, reaction products and unreacted components (A) and/or (B), if any, are advanced from reactor 26 to separator 28. In the case of cellulose fibers and other fibrous constituents for component (B), separator 28 is preferably a rotary vacuum filter which can be of conventional design and construction, the specific design and construction being dependent upon the volume of oil to be processed and the specific nature of the fibrous material. In the case of liquid materials for component (B), the separator 28 is preferably a high speed centrifuge, although separation can also be accomplished by adsorption and/or absorption with clay or cellulose fibers. Again the specific design and construction of separator 28 is dependent upon the volume of oil to be processed and the specific nature of the liquid component (B). The residue from separator 28, i.e., reaction products of the metal contaminants with components (A) and/or (B) and any unreacted components (A) and (B), if present, are advanced to incinerator 14.

The purified oil from separator 28 is advanced to heat exchanger 30 wherein it is heated to a temperature in the range of about 500° F. to about 800° F. The oil is then advanced from heat exchanger 30 to hydrotreater 32. In hydrotreater 32, the oil is subjected to hydrotreating to remove residual polar compounds and unsaturated compounds to obtain a product suitable for use as a fuel or as a feedstock for lubricating oil compositions. The conditions for hydrotreating are well known in the art and include temperatures in the range of about 500° F. to about 800° F., and pressures in the range of about 150 to about 3000 p.s.i.g. in the presence of sufficient hydrogen to effectively remove the undesirable constituents remaining in the oil. Suitable hydrogenation catalyst include, for example, nickel-molybdenum sulfide on alumina, cobalt molybdate, and tungsten-nickel sulfide on alumina, and the like. The design and construction of heat exchanger 30 and hydrotreater 32 is entirely conventional and dependent upon the volume of oil to be processed. The purified oil from hydrotreater 32 is advanced to stripper 34.

Stripper 34 is used to separate from the oil undesirable light hydrocarbons, i.e., hydrocarbons with a boiling point below, for example, about 600° F. or 700° F., that form in the oil as a result of hydrotreatment. The stripper is entirely conventional in design. The stripped oil is suitable for use as lube stock.

An advantage of the foregoing process reclaiming is that relatively high yields of lube stock are provided which have properties comparable to virgin oil. Another advantage is that the relatively small quantities of sludge and other waste materials that are produced can be incinerated to provide a heat source for power generation.

By way of further illustration of the process of the present invention, reference may be made to the following specific examples. Unless otherwise indicated, all parts and percentages are by weight.

EXAMPLE 1

Part A:

A used motor oil is heated to a temperature in the range of 150° to 180° F. and allowed to settle in an insulated settling tank for about 24 hours. Sludge is removed from the bottom of the settling tank. The sludge-free oil is centrifuged in a Sharples Model TI open high speed centrifuge which operates at about 23,000 RPM. The centrifuged oil has a lead content of 1697 ppm. The oil is vacuum dried at a temperature of 350° to 400° F. and a pressure of 10 to 25 torr to remove low boiling hydrocarbons and dissolved gases. The dried and centrifuged oil has the analysis indicated in Table I-A.

The dried and centrifuged oil is advanced from the vacuum drier to a 15-inch thin film, short path centrifugal still (manufactured by Consolidated Vacuum Corporation). The charge to the still is 4385 grams of feed, the distillate is 3816 grams, the consequent yield being 87%. The distilled oil has the analysis indicated in Table I-A.

Part B:

2250 grams of the distillate is stirred with 22.5 grams of Alpha Cellulose Flock, Grade C #40, a product of International Filler Corporation identified as cellulose fibers. The temperature is raised to 250° F. over a period of about one hour. As the temperature is raised, 11.2 grams of $P_2S_5$ are slowly added with stirring. After about one hour of heating and stirring, the $P_2S_5$ is consumed. The suspended solids are removed from the oil by filtration yielding an amber-colored demetallized oil with the properties indicated in Table I-A.

Part C:

1600 grams of the demetallized oil are hydrotreated with HT-500, a product of Harshaw Chemical Company identified as a hydrodesulfurization catalyst, in a stirred pressurized reactor. The catalyst, which is supplied in the form of a 1/16 inch by 3/16 inch extrudate, is ballmilled and screened to a particle size of approximately 60 mesh prior to use. The catalyst is added at a sufficient level to provide a nickel content, based upon the weight of the oil, of 0.1%. The catalyst is activated by injecting carbon disulfide into the oil-catalyst slurry after the reactor is flushed of oxygen with nitrogen and then pressurized with hydrogen to a level of 500 p.s.i.g. The temperature is raised to 650° F. over a period of 1.5 hours during which time the pressure rises to 1050 p.s.i.g. Activation of the catalyst appears to take place at between 450° F. to 475° F. with an attendant drop in pressure of 60 p.s.i.g. Hydrotreatment is continued for an additional hour after which the reactor is allowed to cool down. The hydrotreated oil is removed from the reactor through a bottom drain and separated from catalyst fines by filration. The oil has the following characteristics: color (ASTM D 1500-64) of 1.0, and 0.28% by weight sulfur. The hydrotreated oil is stripped at 380° F. pot temperature and a pressure of 1–2 mm. Hg. in a short column stripping still to remove a 3% overhead of low-boiling hydrocarbons. The resulting oil is essentially odorless and has the properties indicated in Table I-B. For purposes of comparison, typical properties of commercially available virgin base stock, i.e., unused lube stock, are also indicated in Table I-B.

TABLE I-A

| | Dried & Centrifuged | Distilled | Demetallized |
|---|---|---|---|
| Contaminant: | | | |
| Sodium | 14 ppm | 0.00 ppm | 0.00 ppm |
| Calcium | 1718 ppm | 0.00 ppm | 0.00 ppm |
| Lead | 1697 ppm | 626 ppm | 0.00 ppm |
| Zinc | 220 ppm | 15 ppm | 0.00 ppm |
| Sulfur | 0.32 wt. % | 0.29 wt. % | 0.29 wt. % |
| Physical Properties: | | | |
| Neut. Number (ASTM D974-64) | | 0.28A | 0.22A |
| Color (ASTM D1500-64) | 8+ | 3.5 | 3.5 |

TABLE I-B

| | Treated Used Oil (Ex. 1) | Virgin Base Stock |
|---|---|---|
| Component | | |
| Carbon, wt. % | 86.12 | 85.89 |
| Hydrogen, wt. % | 13.63 | 13.79 |
| Sulfur, wt. % | 0.11 | 0.29 |
| Sodium, ppm | 0.00 | 0.00 |
| Physical Properties: | | |
| Color (ASTM D1500-64) | 1.5 | 2.5 |
| Neut. Number (ASTM D974-64) | 0.00 | 0.00 |
| Viscosity at 100° F., SUS (ASTM D2161-74) | 145 | 202 |
| Flash Point by Cleveland Open Cup (ASTM 92-78) | 405 | 405 |
| Rotary Bomb Oxidation (ASTM 2272-67, Conducted at 120° C.) | 94 min. | 53 min. |
| Viscosity Index (ASTM D2270-74) | 98 | 95 |
| Viscosity Gravity Constant (ASTM D2501-67) | 0.8360 | 0.8340 |

The foregoing indicates that in general lube stock prepared from used motor oil in accordance with the process of the present invention exhibits, with the exception of oxygen stability, elemental analysis and physical properties substantially equivalent to that of virgin base stock. The oxygen stability, as measured by the Rotary Bomb Oxidation test method indicated in Table I-B, of the oil produced in accordance with the present invention is significantly superior to the virgin base stock tested.

EXAMPLE 2

A used motor oil is purified of all non-metallic contaminants under the conditions indicated in Part A of Example 1. The sample is demetallized by slurrying 2500 grams of the oil with 30 grams Alpha Cellulose Flock, Grade C #40 and heated with stirring to 160° F. 15 grams of $P_2O_5$ are added to the slurry and the temperature is slowly raised to 220° F. The mixture is stirred for one-half hour at 220° F. The oil is allowed to settle and the solids are removed by filtration through a filter bed of cellulose fibers. The filtrate is amber colored, clear and bright, substantially odorless and exhibits the characteristics indicated in Table II.

TABLE II

| | Dried & Centrifuged | Distilled | Demetallized |
|---|---|---|---|
| Contaminant | | | |
| Sodium | 14 ppm | 0.00 ppm | 0.00 ppm |
| Calcium | 1718 ppm | 0.00 ppm | 0.00 ppm |
| Lead | 1697 ppm | 626 ppm | 0.00 ppm |

TABLE II-continued

| | Dried & Centrifuged | Distilled | Demetallized |
|---|---|---|---|
| Zinc | 220 ppm | 15 ppm | 0.00 ppm |
| Sulfur | 0.32 wt. % | 0.29 wt. % | 0.21 wt. % |
| Physical Properties: | | | |
| Neut. Number (ASTM D974-64) | | 0.28A | 0.28A |
| Color (ASTM D1500-64) | 8+ | 3.5 | 3.0 |

EXAMPLE 3

A used motor oil is purified of all non-metallic contaminants under the conditions indicated in Part A of Example 1. The sample is demetallized by slurrying 2500 grams of the oil with 30 grams of Alpha Cellulose Flock, Grade C #40, and heated with stirring to 160° F. 10 grams of concentrated $H_2SO_4$ are added to the slurry and the temperature is slowly raised to 180° F. The temperature of the mixture is maintained at 180° F. and the mixture is stirred for one-half hour. The oil is allowed to settle and a gray-black cellulose mass is filtered from the oil with a bed of cellulose fibers. The filtrate has an amber color, is essentially odorless, and exhibits the characteristics indicated in Table III.

TABLE III

| | Dried & Centrifuged | Distilled | Demetallized |
|---|---|---|---|
| Contaminant | | | |
| Sodium | 14 ppm | 0.00 ppm | 0.00 ppm |
| Calcium | 1718 ppm | 0.00 ppm | 0.00 ppm |
| Lead | 1697 ppm | 626 ppm | 80 ppm |
| Zinc | 220 ppm | 15 ppm | 0.00 ppm |
| Sulfur | 0.32 wt. % | 0.29 wt. % | 0.28 wt. % |
| Physical Properties | | | |
| Neut. Number (ASTM D974-64) | | 0.22A | 0.33A |
| Color (ASTM D1500-64) | 8+ | 3.5 | 3.5 |

While the invention has been explained in relation to its preferred embodiments, it is to be understood that various modifications thereof will become apparent to those skilled in the art upon reading this specification. Therefore, it is to be understood that the invention disclosed herein is intended to cover such modifications as fall within the scope of the appended claims.

I claim:

1. A process for treating used motor oil or synthetic crude oil comprising:
   (i) separating substantially all water from said used motor oil or said synthetic crude oil to provide a substantially anhydrous used motor oil or synthetic crude oil;
   (ii) contacting said substantially anhydrous used motor oil or synthetic crude oil with an effective amount of (A) a polyfunctional mineral acid and/or the anhydride of said acid and (B) a polyhydroxy compound to react undesired contaminants contained in said used motor oil or synthetic crude oil with components (A) and/or (B) to form one or more reaction products; and
   (iii) separating said reaction products from said used motor oil or synthetic crude oil.

2. The process of claim 1 wherein component (B) is in excess of component (A) during step (ii).

3. The process of claim 1 wherein component (A) is selected from the group consisting of phosphoric acid, sulfuric acid, diphosphorous pentoxide, diphosphorous pentsulfide and sulfur trioxide.

4. The process of claim 1 wherein component (A) is phosphoric acid.

5. The process of claim 1 wherein component (B) is selected from the group consisting of cellulose fibers, polyvinyl alcohol, phenol formaldehyde resin, glycerol and ethylene glycol.

6. The process of claim 1 wherein the temperature of said used motor oil or synthetic crude oil is in the range of about 40° F. to 350° F. during step (ii).

7. The process of claim 1 wherein the temperature of said used motor oil or synthetic crude oil during step (ii) is in the range of about 150° F. to about 250° F.

8. The process of claim 1 wherein the ratio of component (B) to component (A) during step (ii) ranges from a slight excess to about 5:1.

9. The process of claim 1 wherein the ratio of component (B) to component (A) during step (ii) ranges from a slight excess to about 2:1.

10. The process of claim 1 with about 0.1 to about 5% by weight based on the weight of said used motor oil or synthetic crude oil, of component (A) and about 0.1 to about 5% by weight, based on the weight of said used motor oil or synthetic crude oil, of component (B) in step (ii).

11. The process of claim 1 wherein components (A) and (B) are contacted with said used motor oil or synthetic crude oil until substantially all of said undesired contaminants have reacted with components (A) and/or (B).

12. The process of claim 1 wherein said undesired contaminants are nitrogen-containing materials and/or metallic contaminants.

13. A process for treating used motor oil or synthetic crude oil containing undesired nitrogen-containing materials and/or metallic contaminants comprising:
   (i) contacting said used motor oil or synthetic crude oil with an effective amount of (A) a polyfunctional mineral acid and/or the anhydride of said acid and (B) cellulose fibers to react said nitrogen-containing materials and/or metallic contaminants with components (A) and/or (B) to form one or more reaction products; and
   (ii) separating said reaction products from said used motor oil or synthetic crude oil.

14. The process of claim 13 wherein component (B) is in excess of component (A) during step (ii).

15. A process for reducing the metallic content of used motor oil comprising:

(i) separating substantially all water from said used motor oil to provide a substantially anhydrous used motor oil;

(ii) contacting said substantially anhydrous used motor oil with an effective amount of (A) a polyfunctional mineral acid and/or the anhydride of said acid and (B) a polyhydroxy compound until substantially all of said metallic contaminants have reacted with component (A) and/or (B) to form one or more reaction products; and (iii) separating said reaction products from said used motor oil.

16. The process of claim 15 wherein component (A) is selected from the group consisting of phosphoric acid, sulfuric acid, diphosphorous pentoxide, diphosphorous pentsulfide and sulfur trioxide.

17. The process of claim 15 wherein component (A) is phosphoric acid.

18. The process of claim 15 wherein component (B) is selected from the group consisting of cellulose fibers, polyvinyl alcohol, phenol formaldehyde resin, glycerol and ethylene glycol.

19. The process of claim 15 wherein the temperature of said used motor oil is in the range of about 40° F. to 350° F. during step (ii).

20. The process of claim 15 wherein the temperature of said used motor oil during step (ii) is in the range of about 150° F. to about 250° F.

21. The process of claim 15 wherein component (B) is in excess of component (A) during step (ii).

22. The process of claim 15 wherein the ratio of component (B) to component (A), during step (ii) ranges from a slight excess to about 5:1.

23. The process of claim 15 wherein the ratio of component (B) to component (A) during step (ii) ranges from a slight excess to about 2:1.

24. The process of claim 15 with about 0.1 to about 5% by weight, based on the weight of said used motor oil, of component (A), and about 0.1 to about 5% by weight, based on the weight of said used motor oil, of component (B) in step (ii).

25. A process for treating used motor oil or synthetic crude oil comprising:

(i) contacting said used motor oil with (A) from about 0.1 to about 5% by weight based on the weight of said used motor oil or synthetic crude oil of a polyfunctional mineral acid and/or the anhydride of said acid and (B) from about 0.1 to about 5% by weight based on the weight of said used motor oil or synthetic crude oil of cellulose fibers until substantially all of the metallic contaminants in said used motor oil or synthetic crude oil have reacted with component (A) and/or (B) to form one or more reaction products; and (ii) separating said reaction products from said used motor oil or synthetic crude oil.

26. A process for reclaiming used motor oil comprising the steps of:

(i) separating bulk water and solid contaminants from said oil;

(ii) separating fine particulates and remaining suspended water from said oil;

(iii) vacuum drying said oil at a temperature in the range of about 250° F. to about 400° F. and a pressure in the range of about 2 to about 50 torr to remove dissolved water and light hydrocarbons from said oil;

(iv) vacuum distilling said oil at a temperature in the range of about 40° F. to about 350° F. and a pressure in the range of about 0.001 to about 0.1 torr to separate substantially all remaining non-metallic contaminants from said oil;

(v) contacting said oil with an effective amount of (A) a polyfunctional mineral acid and/or the anhydride of said acid and (B) a polyhydroxy compound until substantially all metallic contaminants in said oil have reacted with component (A) and/or (B) to form one or more reaction products;

(vi) separating the reaction products formed in step (v) and any unreacted components (A) and/or (B) from said oil;

(vii) hydrotreating said oil in the presence of hydrogen and a hydrogenation catalyst at a temperature in the range of about 500° F. to about 800° F. to remove residual polar materials and unsaturated compounds; and (viii) stripping said oil to remove light hydrocarbons with boiling point below about 600° F.

27. The process of claim 26 wherein a demulsifying agent is added to said oil prior to or during step (i) to enhance the separation of said water and solid contaminants from said oil.

28. The process of claim 26 wherein the temperature of said oil is in the range of about 100° F. to about 180° F. during step (i).

29. The process of claim 26 wherein said bulk water and solid contaminants are separated from said oil in step (i) in a settling tank, the average residence time of said oil in said settling tank being in the range of about 12 to about 24 hours.

30. The process of claim 26 wherein said fine particulates and remaining suspended water are separated from said oil during step (ii) in a high speed centrifuge.

31. The process of claim 26 wherein said oil is distilled during step (iv) in a thin film short path still.

32. The process of claim 26 wherein component (A) is selected from the group consisting of phosphoric acid, sulfuric acid, diphosphorous pentoxide, diphosphorous pentsulfide and sulfur trioxide.

33. The process of claim 26 wherein component (A) is phosphoric acid.

34. The process of claim 26 wherein component (B) is selected from the group consisting of cellulose fibers, polyvinyl alcohol, phenol formaldehyde resin, glycerol and ethylene glycol.

35. The process of claim 26 wherein the temperature of said oil during step (v) is in the range of about 40° F. to about 350° F.

36. The process of claim 26 wherein the ratio of component (B) to component (A) ranges from a slight excess to about 5:1 during step (v).

37. The process of claim 26 wherein the ratio of component (B) to component (A) ranges from a slight excess to about 2:1 during step (v).

38. The process of claim 26 wherein the pressure during step (vii) is in the range of about 150 to about 3000 p.s.i.g.

39. The process of claim 26 wherein the catalyst used in step (vii) is selected from the group consisting of nickel-molybdenum sulfide on alumina, cobalt molybdate and tungsten-nickel sulfide on alumina.

40. The process of claim 26 wherein component (B) is in excess of component (A) during step (v).

41. A process for reclaiming used motor oil comprising the steps of:

(i) separating bulk water and solid contaminants from said oil;

(ii) separating fine particulates and remaining suspended water from said oil;

(iii) vacuum drying said oil at a temperature in the range of about 250° F. to about 400° F. and a pressure in the range of about 2 to about 50 torr to remove dissolved water and light hydrocarbons from said oil;

(iv) vacuum distilling said oil at a temperature in the range of about 40° F. to about 350° F. and a pressure in the range of about 0.001 to about 0.1 torr to separate substantially all remaining non-metallic contaminants from said oil;

(v) contacting said oil with (A) from about 0.1 to about 5% by weight based on the weight of said oil of a polyfunctional mineral acid and/or the anhydride of said acid and (B) from about 0.1 to about 5% by weight based on the weight of said oil of cellulose fibers until substantially all metallic contaminants in said oil have reacted with component (A) and/or (B) to form one or more reaction products;

(vi) separating the reaction products formed in step (v) and any unreacted components (A) and/or (B) from said oil;

(vii) hydrotreating said oil in the presence of hydrogen and a hydrogenation catalyst at a temperature in the range of about 500° F. to about 800° F. to remove residual polar materials and unsaturated compounds; and (viii) stripping said oil to remove light hydrocarbons with boiling point below about 600° F.

42. The process of claim 41 wherein component (B) is in excess of component (A) during step (v).

43. A process for treating used motor oil or synthetic crude oil comprising:

(i) contacting said used motor oil or synthetic crude oil with an effective amount of (A) a polyfunctional mineral acid and/or the anhydride of said acid and (B) cellulose fibers to react undesired contaminants contained in said used motor oil or synthetic crude oil with components (A) and/or (B) to form one or more reaction products; and (ii) separating said reaction products from said used motor oil or synthetic crude oil.

44. A process for reducing the metallic content of used motor oil comprising:

(i) contacting said used motor oil with an effective amount of (A) a polyfunctional mineral acid and/or the anhydride of said acid and (B) cellulose fibers until substantially all of said metallic contaminants have reacted with component (A) and/or (B) to form one or more reaction products; and (ii) separating said reaction products from said used motor oil.

45. A process for reclaiming used motor oil comprising the steps of:

(i) separating bulk water and solid contaminants from said oil;

(ii) separating fine particulates and remaining suspended water from said oil;

(iii) vacuum drying said oil at a temperature in the range of about 250° F. to about 400° F. and a pressure in the range of about 2 to about 50 torr to remove dissolved water and light hydrocarbons from said oil;

(iv) vacuum distilling said oil at a temperature in the range of about 40° F. to about 350° F. and a pressure in the range of about 0.001 to about 0.1 torr to separate substantially all remaining non-metallic contaminants from said oil;

(v) contacting said oil with an effective amount of (A) a polyfunctional mineral acid and/or the anhydride of said acid and (B) cellulose fibers until substantially all metallic contaminants in said oil have reacted with component (A) and/or (B) to form one or more reaction products;

(vi) separating the reaction products formed in step (v) and any unreacted components (A) and/or (B) from said oil;

(vii) hydrotreating said oil in the presence of hydrogen and a hydrogenation catalyst at a temperature in the range of about 500° F. to about 800° F. to remove residual polar materials and unsaturated compounds; and (viii) stripping said oil to remove light hydrocarbons with boiling point below about 600° F.

* * * * *